US008777512B2

(12) United States Patent
Henderson

(10) Patent No.: US 8,777,512 B2
(45) Date of Patent: Jul. 15, 2014

(54) VERTICALLY STACKABLE AND RETROFITTABLE TRAFFIC CONE LINKING

(76) Inventor: David Henderson, Coral Gables, FL (US)

( * ) Notice: Subject to any disclaimer, the term of this patent is extended or adjusted under 35 U.S.C. 154(b) by 19 days.

(21) Appl. No.: 13/436,191

(22) Filed: Mar. 30, 2012

(65) Prior Publication Data

US 2013/0255122 A1 Oct. 3, 2013

(51) Int. Cl.
*E01F 9/00* (2006.01)
*E01F 9/012* (2006.01)

(52) U.S. Cl.
USPC ..... 404/9; 116/63 C; 116/63 P

(58) Field of Classification Search
USPC ..... 404/6, 9, 10, 13; 116/63 C, 63 P, 63 R; 49/49; 40/607.02, 607.06, 607.07, 40/607.1, 608; 256/23
See application file for complete search history.

(56) References Cited

U.S. PATENT DOCUMENTS

| | | | | | |
|---|---|---|---|---|---|
| 2,315,516 | A * | 4/1943 | Gray | 256/1 |
| 2,906,507 | A * | 9/1959 | Hodson | 256/48 |
| 3,782,322 | A * | 1/1974 | Wilson | 116/63 P |
| 5,467,548 | A | 11/1995 | Ross | |
| 5,577,824 | A * | 11/1996 | Wright | 340/908.1 |
| 5,755,174 | A * | 5/1998 | Freeman | 116/63 C |
| 5,775,016 | A * | 7/1998 | Chien | 40/544 |
| 5,888,016 | A * | 3/1999 | Ahn | 404/10 |
| 6,053,657 | A | 4/2000 | Signorelli | |
| 6,971,329 | B1 * | 12/2005 | Stewart | 116/63 C |
| 7,538,688 | B1 | 5/2009 | Stewart | |
| 2004/0060499 | A1 | 4/2004 | Penque, Jr. | |
| 2006/0032426 | A1 | 2/2006 | Kuo | |
| 2006/0266274 | A1 * | 11/2006 | Kuo | 116/63 P |
| 2009/0077848 | A1 * | 3/2009 | Dicke | 40/586 |
| 2010/0090184 | A1 * | 4/2010 | Manning | 256/1 |
| 2011/0220010 | A1 * | 9/2011 | Klein et al. | 116/63 |
| 2011/0308446 | A1 * | 12/2011 | Butler | 116/63 |
| 2012/0076970 | A1 * | 3/2012 | Suter | 428/80 |
| 2012/0186511 | A1 * | 7/2012 | Spray | 116/63 |

FOREIGN PATENT DOCUMENTS

| | | | |
|---|---|---|---|
| GB | 2171440 A | * | 8/1986 |
| GB | 2182965 A | * | 5/1987 |

* cited by examiner

*Primary Examiner* — Abigail A Risic
(74) *Attorney, Agent, or Firm* — Craig Kirsch

(57) ABSTRACT

A vertically stackable and retrofittable traffic cone linking system having a plurality of linking cuffs substantially conically shaped linking cuffs having four connection points, sized and configured to be removably secured to a standard traffic cone and a traffic cone linking connector removably connected to the linking cuffs. Once the traffic cone linking cuff is linked to the traffic cone linking connector, the traffic cone linking system can be can be arranged in a predetermined configuration or arrangement to alert onlookers of a particular hazard or to impede access to a given location.

15 Claims, 4 Drawing Sheets

VERTICALLY STACKABLE AND RETROFITTABLE TRAFFIC CONE LINKING

BACKGROUND

The present invention relates to safety marking devices, specifically, a vertically stackable safety marking devices that can be retrofitted to existing safety markers in the form of a modular traffic cone linking system that can be retrofitted to mount on existing traffic cones thereby allowing for standard traffic cones to be linked together in a predetermined arrangement so as to alert onlookers of a particular hazard or to impede access to a given location.

Standard traffic cones are known in the art and have been used as safety markers for decades. Standard traffic cones known in the art vary in size, material composition, and color; however standard traffic cones share the common features of a substantially hollow conical member rising perpendicular from a substantially flat base member that defines an opening sized and configured to receive the conical member of another traffic cone, thereby allowing multiple traffic cones to be stacked one on the other. Most standard traffic cones also include an opening at the top end of the conical member.

Standard traffic cones are mass produced and used either singularly or in groups of varying sizes to mark and otherwise alert onlookers of hazards on the ground. The ability to configure and arrange multiple traffic cones into configurations and arrangements limited only by the number of available cones has largely been considered a strength of the standard traffic cone marking device.

Configurations and arrangements of multiple standard traffic cones suffer from a fundamental design defect, i.e. the cones are not linked together. The failure to connect standard traffic cones into a single marking system renders the deterrent nature and the communicative properties of the marking device less effective than that of a marking system comprised of a plurality of standard traffic cones that are connected together.

In order to address this fundamental design defect found in standard traffic cones, the inventor invented the present invention, specifically a vertically stackable safety marking device system that can be retrofitted to existing safety markers in the form of a modular traffic cone linking system that can be retrofitted to mount on existing traffic cone thereby allowing for standard traffic cones to be linked together in a predetermined arrangement so as to alert onlookers of a particular hazard or to impede access to a given location.

The inventor of the present invention observed that most major metropolitan cities have large supplies of existing standard traffic cones and that by retrofitting existing traffic cones with the "cuff and linking member" system contemplated in the present application, the plethora of existing traffic cones can be put to better use and more effectively communicate hazards to onlookers in a cost effective manner while essentially recycling existing traffic cones.

The stackable nature of the standard traffic cone, i.e. the ability of multiple traffic cones to be stacked one on the other makes the standard traffic cone not only a cost efficient communicative device but also a device that does not have a large foot print thereby minimizing floor space needed for storage. As a point of fact, several traffic cones stacked vertically have the same foot print and therefore require the same amount of floor or shelf space as a single traffic cone.

With this in mind, the inventor of the present invention wanted to ensure that his invention could be easily stored in minimal floor or shelf space and therefore the same stackable feature was incorporated into the present invention.

An objective of the present invention is to provide a traffic cone linking system that can be retrofitted to be removably attachable to existing standard traffic cones.

Another objective of the present invention is to provide a traffic cone linking system that forms a barrier between two existing traffic cones.

Still another objective of the present invention is to provide a traffic cone linking system that can be configured to link existing traffic cones in a plurality of geometric shapes.

Yet still another objective of the present invention is to provide a traffic cone linking system wherein the linking cuffs of the linking system are vertically stackable and therefore can be stored in a limited amount of floor or shelf space.

Information relevant to address these objectives can be found in U.S. Pat. No. 5,467,548; U.S. Patent Application No. 2006/0032426; U.S. Pat. No. 7,538,688; U.S. Pat. No. 6,053,657 and U.S. Patent Application No. 2004/0060499; however, none of these references are meant to be retrofitted to existing traffic cones to be configurable in a plurality of geometric shapes.

For the foregoing reasons, there is a need for a vertically stackable safety marking devices that can be retrofitted to existing safety markers in the form of a modular traffic cone linking system that can be retrofitted to mount on existing traffic cones thereby allowing for standard traffic cones to be linked together in a predetermined arrangement so as to alert onlookers of a particular hazard or to impede access to a given location.

SUMMARY

The present invention is directed towards safety marking devices, specifically, vertically stackable safety marking devices that can be retrofitted to existing safety markers in the form of a modular traffic cone linking system that can be retrofitted to mount on existing traffic cones thereby allowing for standard traffic cones to be linked together in a predetermined arrangement so as to alert onlookers of a particular hazard or to impede access to a given location.

The present invention comprises of a vertically stackable linking cuff and a traffic cone linking connector. The linking cuff comprises of a substantially conical body sized and configured to engage the outer surface of a standard traffic cone. The conical body defines a top opening and a bottom opening wherein the bottom opening further defines four linking points. The interior of the linking cuff defines a plurality of air flow channels such that the interior of the linking cuff is not in continuous direct contact with the exterior of the traffic cone. The traffic cone linking connector comprises of a linking means sized and configured to engage at least one of the linking points of the linking cuff thereby linking at least two traffic cones together when the present invention is placed thereon.

The present invention addresses one of the fundamental shortcomings of the standard traffic cone marking device, i.e. standard traffic cone marking devices cannot be easily connected or otherwise linked together.

DRAWINGS

These and other features, aspects, and advantages of the present invention will become better understood with regard to the following description, appended claims and drawings where:

DESCRIPTION

Figure 1:
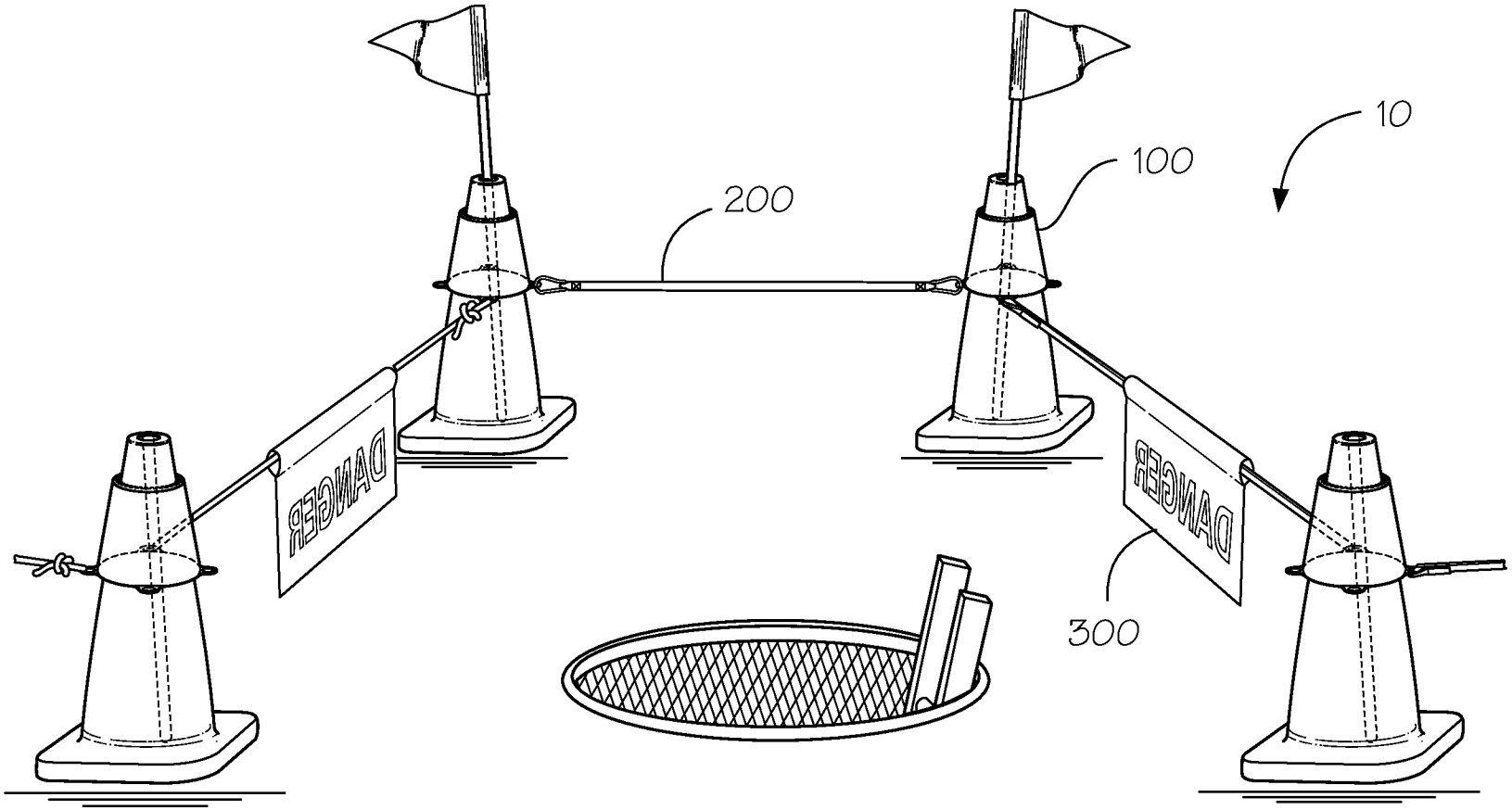
FIG. 1 shows a perspective view of one embodiment of the present invention with four linking cuffs engaged with four standard traffic cones and a linking connectors with signage elements linked together thereby forming a barrier around a ground hazard.

As shown in FIG. 1, a vertically stackable and retrofittable traffic cone linking system 10 comprising a plurality of linking cuffs 100 and at least one linking connector 200.

Figure 2:
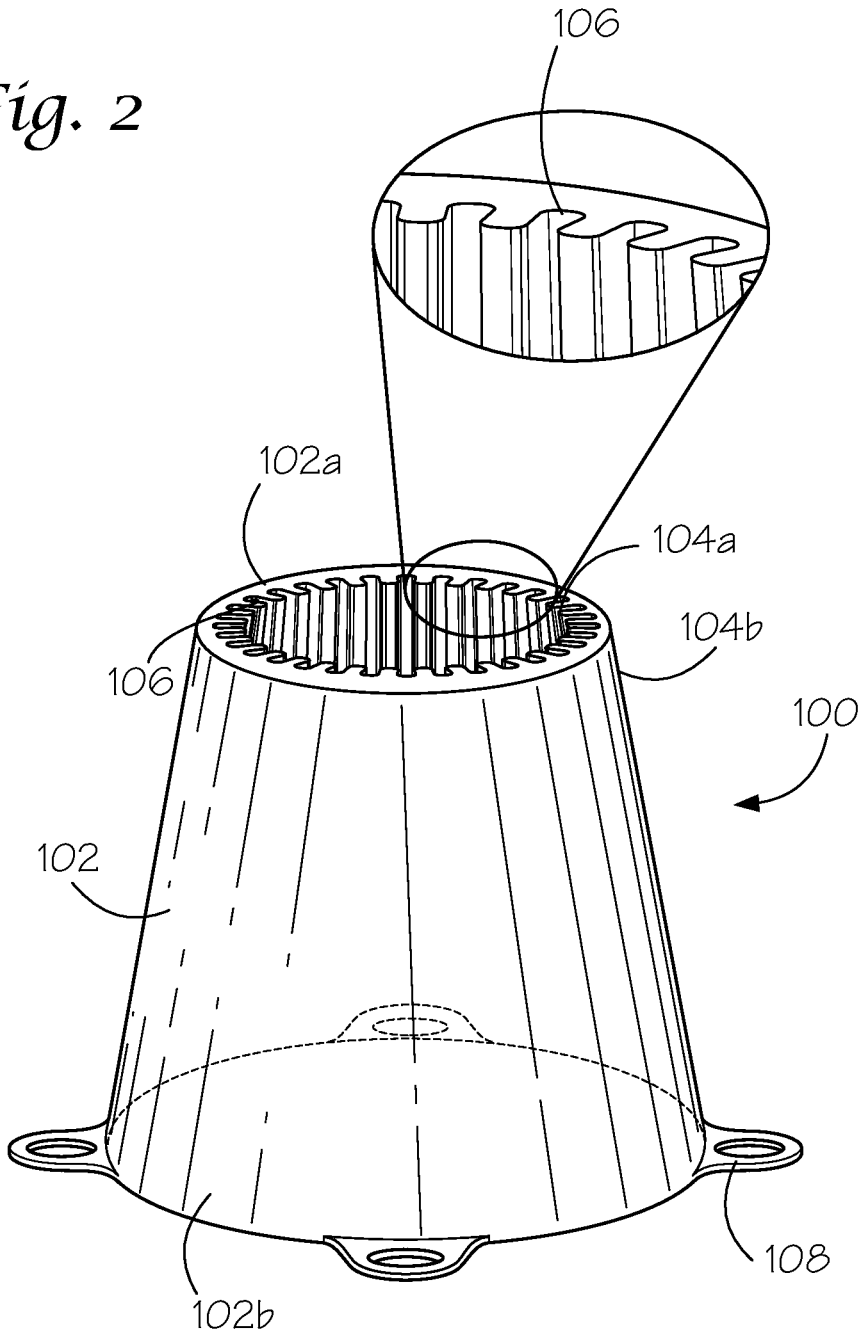
FIG. 2 shows a perspective view of one embodiment of the linking cuff of the present invention with a close up view of one embodiment of the air flow channels.
Figure 3:
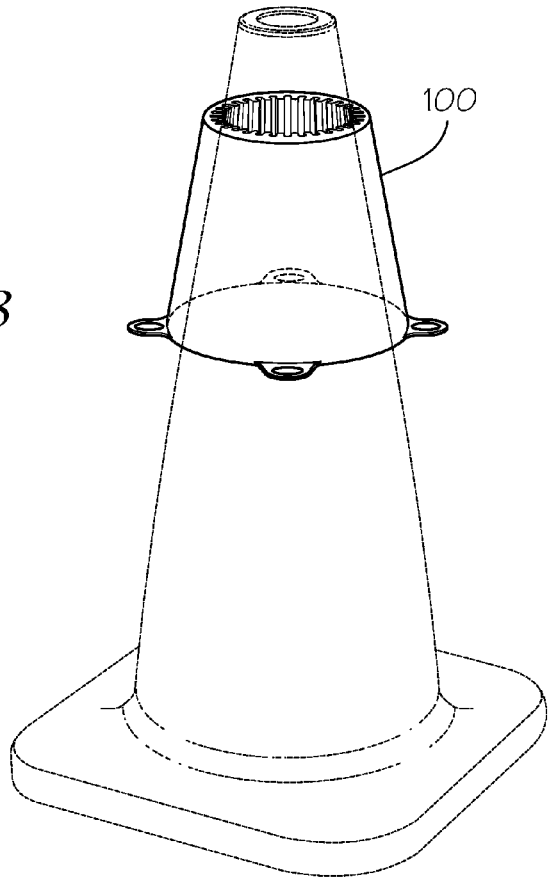
FIG. 3 shows a cut away view of an alternative embodiment of the air flow channels of the linking cuff of the present invention.
Figure 4:
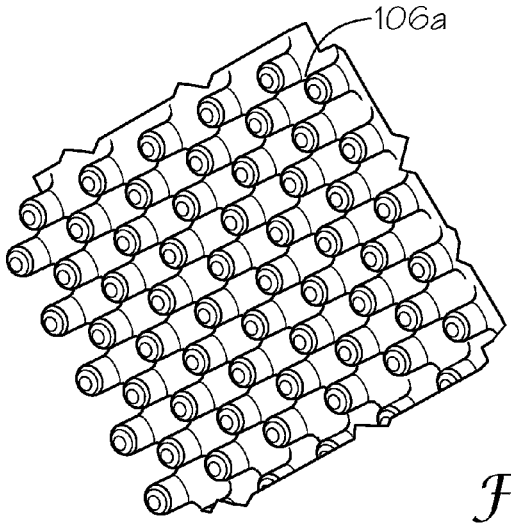
FIG. 4 shows a perspective view of one embodiment of the linking cuff of the present invention engaged with a standard traffic cone.
Figure 5A:
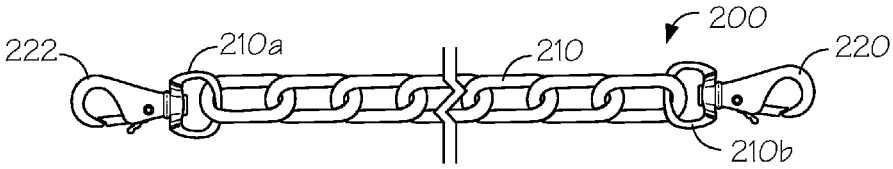
FIG. 5A shows top view of one embodiment of the traffic cone linking connector of the present invention.
Figure 5B:
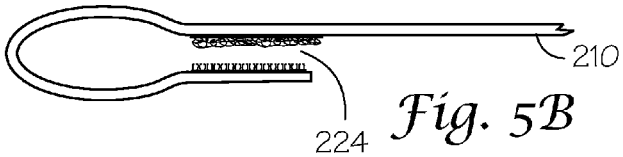
FIG. 5B shows top view of an alternative embodiment of the traffic cone linking connector of the present invention.
Figure 5C:
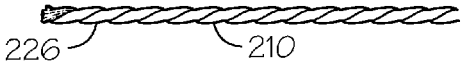
FIG. 5C shows top view of a second alternative embodiment of the traffic cone linking connector of the present invention.
Figure 6:
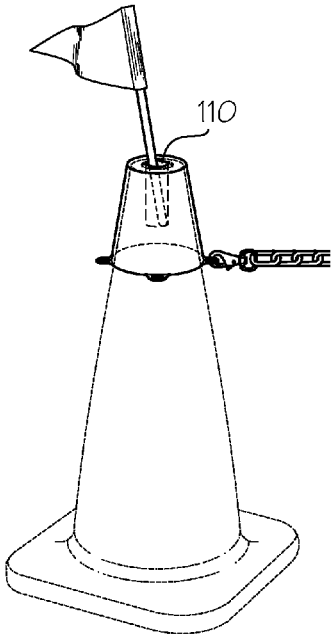
FIG. 6 shows an alternative embodiment of the linking cuff of the present invention engaged with a standard traffic cone.
Figure 7:
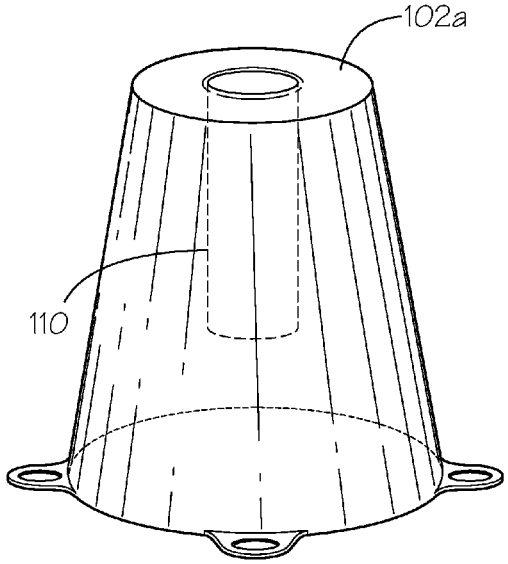
FIG. 7 shows a prospective view of an alternative embodiment of the linking cuff of the present invention.

As shown in FIG. 2, the linking cuff 100 comprises of a substantially hollow and conically shaped body 102 having an open top end 102*a*, an open bottom end 102*b*, an inner surface 104*a* and an outer surface 104*b*. It is envisioned that the open top end 102*a* might define a circular opening from about 2 inches in diameter to about 4 inches in diameter and the open bottom end might define a circular opening from about 5 inches in diameter to about 10 inches in diameter. It is further envisioned that the cuff might be from about 5 inches to about 10 inches in overall length from the open top end 102*a* to the open bottom end 102*b* and have a smaller circumference at the open top end 102*a* than the open bottom end 102*b*. Each linking cuff 100 is sized and configured such that the inner surface 104*a* of the cuff 100 engages the outer surface of a standard traffic cone thereby removably securing the cuff 100 to the traffic cone.

The inner surface 104*a* of the linking cuff 100 defines a plurality of airflow channels 106. In one embodiment of the present invention, the inner surface of the cuff 104*a* defines a plurality of filament like protrusions 106*a* sized and configured to create air flow between the inner surface 104*a* of the cuff 100 and the outer surface of a standard traffic cone thereby reducing the surface area of the inner surface 104*a* of the cuff that directly contacts the outer surface of the traffic cone.

In an alternative embodiment of the present invention, the inner surface of the cuff 104*a* defines a plurality of ridges 106*b* sized and configured to create air flow between the inner surface 104*a* of the cuff 100 and the outer surface of a standard traffic cone thereby reducing the surface area of the inner surface 104*a* of the cuff that directly contacts the outer surface of the traffic cone.

The plurality of airflow channels 106 integral to the inner surface 104*a* of the linking cuff 100 prevent the inner surface 104*a* of the linking cuff 100 from continuous direct contact with the outer surface of the standard traffic cone, thereby preventing the linking cuff 100 from being fused, melted, or otherwise substantially permanently affixed to the traffic cone.

The outer surface 104*b* of the linking cuff 100 define four connecting points 108. It is envisioned that connecting points 108 of the outer surface 104*b* of the cuff 100 are coplanar to the bottom end 102*b* of the cuff 100 and perpendicular to the outer surface 104*b* of the cuff 100, sized and configured such that a plurality of cuffs 100 may be vertically stacked one on the other.

It is envisioned that the linking cuff 100 might be composed of a light weight, durable, weather resistant material such as plastic or hard rubber having a thickness of about 1/16 of an inch. It is further envisioned that the linking cuff 100 might include enhanced visual indicators such as neon colored portions and/or portions having retro-reflective or photoluminescent qualities.

In an alternative embodiment, the top end 102*a* of the cuff 100 defines a closed cylindrical depression 110, sized and configured to engage the opening of a standard traffic cone and support a supplemental visual indicator such as a sign or a flag.

The traffic cone linking connector 200, comprises of a connector body 210, having a first end 210*a* and a second end 210*b* and a connecting means 220 for removably connecting each end of the traffic cone linking connector 200 to a connecting point 108 on the cuff 100. It is further envisioned that the present invention might further comprise of a signage element 300 removably attached to the traffic cone linking connector 200. It is envisioned that the connecting means 220 might include a spring loaded securing mechanism 222 or a hook and loop 224 securing means. It is further envisioned that the linking connector 200 might be a light weight plastic chain or metal chain of a predetermined length. It is also envisioned that the linking connector 200 might be a light weight cord 226 of a predetermined weight.

In operation a user first slides a linking cuff 100 onto an existing traffic cone until the circumference of the open bottom end 102*b* of the cuff 100 prevents the cuff 100 from sliding further down the traffic cone and then the user attaches the linking connector 200 to one of the connector points 108 of the cuff 100. These steps are repeated as many times as necessary and the then connected traffic cones can be arranged in a predetermined configuration or arrangement to alert onlookers of a particular hazard or to impede access to a given location.

An advantage of the present invention is that it provides a traffic cone linking system that can be retrofitted to be removably attachable to existing standard traffic cones.

Another advantage of the present invention is that it provides a traffic cone linking system that forms a barrier between two existing traffic cones.

Still another advantage of the present invention is that it provides a traffic cone linking system that can be configured to link existing traffic cones in a plurality of geometric shapes.

Yet still another advantage of the present invention is that it provides a traffic cone linking system wherein the linking cuffs of the linking system are vertically stackable and therefore can be stored in a limited amount of floor or shelf space.

Although the present invention has been described in considerable detail with reference to certain preferred versions thereof, other versions are possible. Therefore, the spirit and the scope of the claims should not be limited to the description of the preferred versions contained herein.

What is claimed is:

1. A vertically stackable and retro-fittable to existing traffic cones, traffic cone linking system with a vertical member comprising:

a plurality of stackable linking cuffs, wherein each cuff comprises of a substantially hollow and conically shaped vertical body having a top end, a bottom end, an inner surface and an outer surface, the circumference of the top end is smaller than the circumference of the bottom end, the inner surface defines a plurality of airflow channels, and the outer surface defines four connecting points, each cuff can be housed within another stackable linking cuff such that when multiple linking cuffs are stacked together, each linking cuff is substantially housed within the conically shaped vertical body of the preceding stackable linking cuff so that a minimal amount of floor or shelf space is required to store the stacked plurality of stackable linking cuffs, each cuff is sized and configured such that the inner surface of the cuff engages the outer surface of a standard traffic cone thereby removably securing the cuff to the traffic cone and each connecting point on the cuff is coplanar to the bottom end of the cuff and extends outward from the bottom end of the cuff and substantially perpendicular to the vertical body of the cuff; and a traffic cone linking connector, wherein the connector comprises of a substantially non-rigid connector body, having a first end and a second end and a connecting means for removably connecting each end of the traffic cone linking connector to a connecting point on the cuff.

2. The traffic cone linking system of claim 1, wherein the inner surface of the cuff defines a plurality of filament like protrusions sized and configured to create air flow between the inner surface of the cuff and the outer surface of a standard traffic cone there by reducing the surface area of the inner surface of the cuff that directly contacts the outer surface of the traffic cone.

3. The traffic cone linking system of claim 1, wherein the inner surface of the cuff defines a plurality of ridges sized and configured to create air flow between the inner surface of the cuff and the outer surface of a standard traffic cone thereby reducing the surface area of the inner surface of the cuff that directly contacts the outer surface of the traffic cone.

4. The traffic cone linking system of claim 2, wherein connecting points of the outer surface of the cuff are coplanar to the bottom end of the cuff and perpendicular to the outer surface of the cuff, sized and configured such that a plurality of cuffs may be vertically stacked one on the other.

5. The traffic cone linking system of claim 4, wherein the traffic cone linking system further comprises of a signage element removably attached to the traffic cone linking connector.

6. The traffic cone linking system of claim 5 wherein the cuff further comprises a retro-reflective element.

7. The traffic cone linking system of claim 6 wherein the cuff is from about 5 inches to about 10 inches in length from the top end to the bottom end of the cuff.

8. The traffic cone linking system of claim 7 wherein the top end of the cuff defines a circular opening from about 5 inches in diameter to about 10 inches in diameter and the bottom end of the cuff defines a circular opening from about 2 inches in diameter to about 4 inches in diameter.

9. The traffic cone linking system of claim 8, wherein the thickness between inner surface and the outer surface of the cuff is approximately 1/16 of an inch.

10. The traffic cone linking system of claim 9, wherein the cuff is composed of a light weight plastic material.

11. The traffic cone linking system of claim 10 wherein the traffic cone linking connection means comprises of a spring loaded mechanism.

12. The traffic cone linking system of claim 10 wherein the traffic cone linking connector is a light weight substantially non rigid chain of a predetermined length.

13. The traffic cone linking system of claim 10 wherein the traffic cone linking connector is a light weight substantially non rigid cord of a predetermined length.

14. The traffic cone linking system of claim 1, wherein the top end of the cuff defines a closed cylindrical depression, sized and configured to engage the opening of a standard traffic cone and support a supplemental visual indicator.

15. A vertically stackable and retro-fittable to existing traffic cones traffic cone linking system with a vertical member comprising:

a plurality of stackable vertical linking cuffs, composed of a light weight plastic material having a retro-reflective element wherein each cuff comprises of a substantially hollow and conically shaped vertical body having a top end, a bottom end, an inner surface and an outer surface, the cuff is from about 5 inches to about 10 inches in length from the top end to the bottom end of the cuff about its vertical axis, the top end of the cuff defines a circular opening from about 2 inches in diameter to about 4 inches in diameter and the bottom end of the cuff defines a circular opening from about 5 inches in diameter to about 10 inches in diameter such that the circumference of the top end is smaller than the circumference of the bottom end, each cuff is sized and configured such that the inner surface of the cuff engages the outer surface of a standard traffic cone thereby removably securing the cuff to the traffic cone, the inner surface of the cuff defines a plurality of airflow channels in the form of a plurality of filament like protrusions sized and configured to create air flow between the inner surface of the cuff and the outer surface of a standard traffic cone thereby reducing the surface area of the inner surface of the cuff that directly contacts the outer surface of the traffic cone, and the outer surface defines four connecting points, wherein each connecting point on the cuff is coplanar to the bottom end of the cuff and extends outward from the bottom end of the cuff and substantially perpendicular to the vertical body of the cuff and each cuff can be housed within another stackable linking cuff such that when multiple linking cuffs are stacked together, each linking cuff is substantially housed within the conically shaped vertical body of the preceding stackable linking cuff so that a minimal amount of floor or shelf space is required to store the stacked plurality of stackable linking cuffs;

a traffic cone linking connector, wherein the connector comprises a light weight, substantially non rigid connector body, having a first end and a second end and a spring loaded connection means for removably connecting each end of the traffic cone linking connector to one of the connecting points on the outer surface of the linking cuff; and a signage element removably attached to the traffic cone linking connector.

* * * * *